United States Patent [19]

Carter

[11] 4,330,095

[45] May 18, 1982

[54] FREE STANDING, MULTIPLE SKEIN YARN HOLDER AND DISPENSER

[76] Inventor: Gilbert J. Carter, 525 Park Blvd. #43, Ogden, Utah 84401

[21] Appl. No.: 173,740

[22] Filed: Jul. 30, 1980

[51] Int. Cl.[3] ..... B65H 49/00; D01H 7/16

[52] U.S. Cl. ..... 242/129.5; 242/146

[58] Field of Search ..... 242/127, 129.5, 134, 242/136, 137.1, 139, 146, 171, 172; 66/1 R, 1 A

[56] References Cited

U.S. PATENT DOCUMENTS

| | | | |
|---|---|---|---|
| 2,254,468 | 9/1941 | Benson | 242/130 |
| 2,545,505 | 3/1951 | Wall | 40/27 |
| 2,733,877 | 2/1956 | Cunningham | 242/139 |
| 3,377,035 | 4/1968 | Sparr | 242/139 |
| 3,593,943 | 7/1971 | Coleman | 242/129 |
| 4,112,711 | 9/1978 | Tripp | 66/1 A |

FOREIGN PATENT DOCUMENTS

| | | | |
|---|---|---|---|
| 752077 | 9/1933 | France | 242/146 |

*Primary Examiner*—Leonard D. Christian
*Attorney, Agent, or Firm*—A. Ray Osburn

[57] ABSTRACT

A free standing yarn holder and dispenser comprising a floor contacting base, an upstanding stem supporting a capital with outstanding, spaced apart circumferential hooks, and one or more bags each adapted to contain a skein of yarn and to be held generally vertically by one of the hooks. The bags are each preferably proportioned to retain the skein with its longitudinal axis disposed generally vertically, so that the yarn strand may be withdrawn freely as required by the knitter through an upwardly disposed perforation provided through the wall of the bag. The dispenser relieves the knitter of vexatious tangling of the individual yarn strands and jumbling of the skeins.

11 Claims, 6 Drawing Figures

FREE STANDING, MULTIPLE SKEIN YARN HOLDER AND DISPENSER

BACKGROUND OF THE INVENTION

1. Field

The field of the invention is devices aiding knitters and more particularly devices for storing and dispensing yarn therefor.

2. State of the Art

A knitter may use one or several strands of yarn, depending upon the article to be made, the selection of stitching, and the pattern desired, which may require multiple yarn colors, sizes and textures. Individual skeins of yarn tend to roll eratically as the strand is withdrawn, leading to tangling of strands, which is often aggravated by the playful curiosity of pets and small children. The skeins may be restrained inside a bag or basket, but the orientation of the skeins is then jumbled and tangling still occurs, and the strands often cannot be freely withdrawn. The knitter is nomally seated, with both hands occupied in manipulating the needles, and cannot attend to freeing the tangled strands without vexatious and time consuming interuptions. Such interuptions also tend to impair the uniformity and quality of the knitted article. Further, the gathering of individual skeins for moving to another location, or for storage between knitting sessions, is inconvenient and further aggravates the tangling problem.

BRIEF SUMMARY OF THE INVENTION

With the foregoing in mind, the present invention eliminates or substantially alleviates the foregoing disadvantages in the prior art by providing a free standing yarn dispenser wherein the skeins may be individually and separately disposed in proper orientation to permit free withdrawal of the strand of each skein by the knitter as required. According to the presently preferred embodiment, the yarn dispenser may comprise a floor contacting base, a stem upstanding from the base and supporting a capital with a plurality of outstanding hooking members spaced apart therearound, and one or more elongate bags generally conforming to skein diameter and each held in vertical position by a one of the hooking members. The strand is withdrawn from the center of the skein preferably through a perforation provided through the wall of the bag above the skein. The stand is easily removeable, the skeins remaining stored untangled in the bags.

It is a principal object of the invention to provide a free standing device to aid in knitting, crocheting and the like which permits the individual strands from a plurality of skeins of yarn to be utilized simultaneously without tangling of the strands or tumbling of the skeins. Another object is to provide readily portable storage means for the skeins in readiness for such use.

BRIEF DESCRIPTION OF THE DRAWINGS

The following figures represent the presently preferred embodiment of the invention.

DETAILED DESCRIPTION OF ILLUSTRATED EMBODIMENTS

Figure 1:
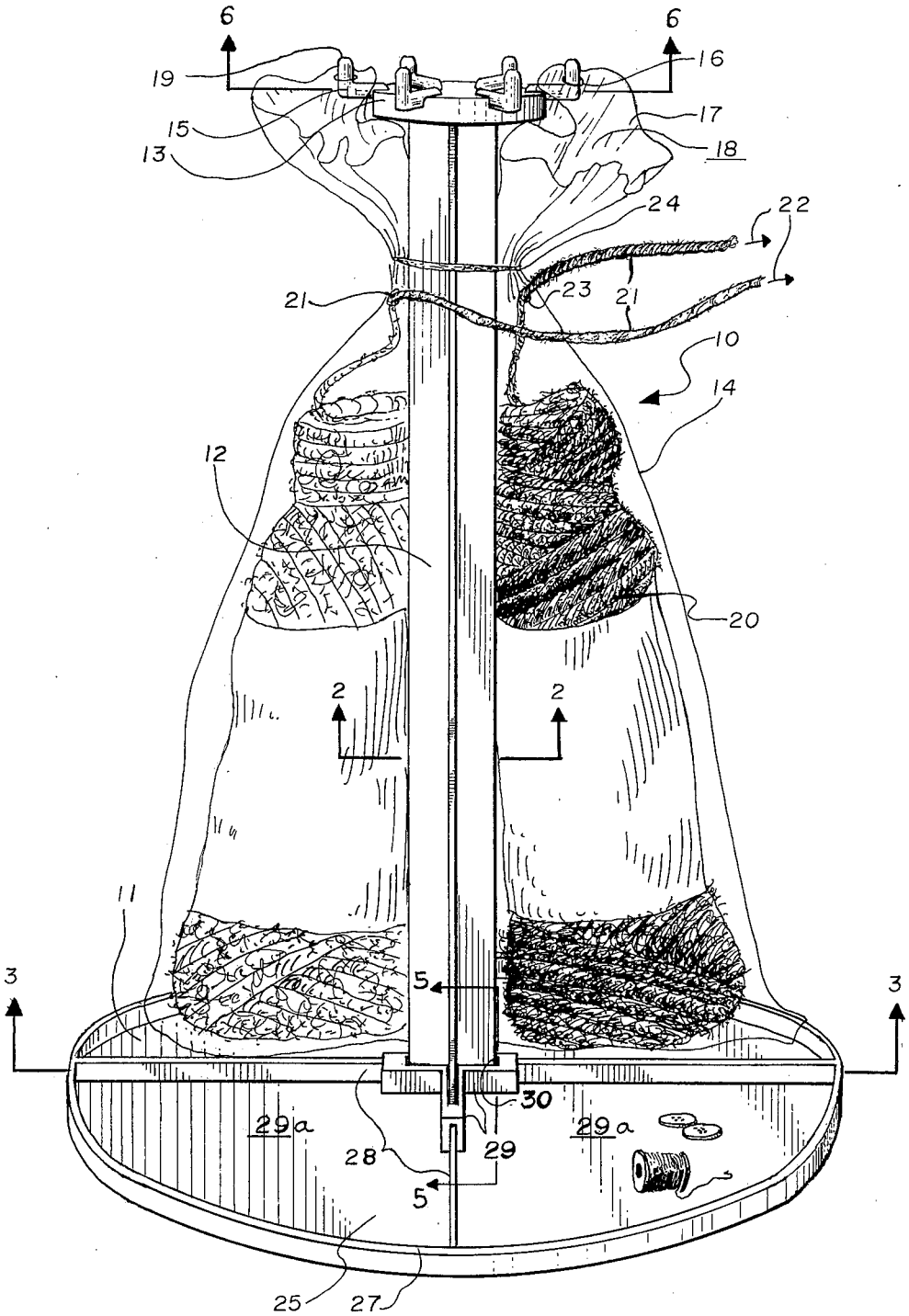
FIG. 1 is a perspective view of a yarn holder and dispenser in accordance with the invention.
Figure 2:
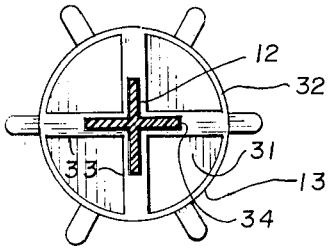
FIG. 2 is a cross sectional view taken along line 2—2 of FIG. 1, drawn to the scale thereof.
Figure 3:
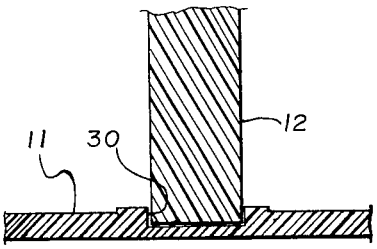
FIG. 3 is a fragmentary cross sectional taken along line 3—3 of FIG. 1, drawn to the scale thereof.
Figure 4:
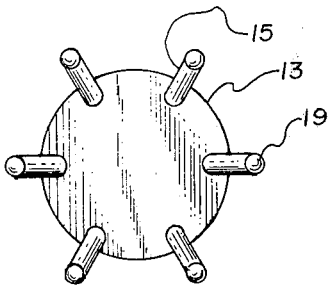
FIG. 4 is a plan view of the stem capital of the invention, drawn to the scale of FIG. 1.
Figure 5:
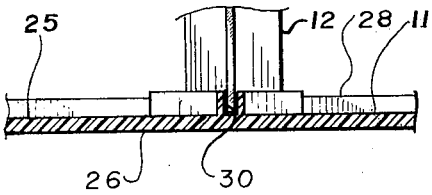
FIG. 5 is a fragmentary cross sectional view taken along line 5—5 of FIG. 1, drawn to the scale thereof.
Figure 6:
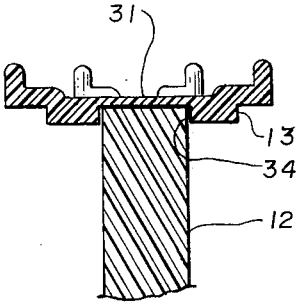
FIG. 6 is a fragmentary cross sectional view taken along line 6—6 of FIG. 1, drawn to the scale thereof.

The yarn dispensing stand, generally 10, seen in FIG. 1, comprises a circular base 11, an upstanding stem 12, an uppermost stem capital 13 and a plurality of elongate upwardly opening skein bags 14, two of which are illustrated in FIG. 1, each supported generally vertically by one of a plurality of bag hooks 15. A hook perforation 16 is provided through wall 17 of each skein bag 14 near its upwardly disposed open end 18, which perforation is engaged by an upwardly projecting stud portion 19 of one of the hooks 15. When yarn stand 10 is prepared for use by a knitter, one or more of the bags 14 contains a skein 20 of yarn, a strand 21 of which may be drawn by the knitter as indicated by arrows 22 from the skein center to the knitting piece, not shown. Preferably, a strand withdrawal perforation 23 is provided through the wall of each bag 14 above skein 20, so that the open ends 18 thereabove may be gathered by an elastic band 24, for neatness of appearance and exclusion of dust and lint.

Yarn skeins 20 typically comprise the single strand 21 of yarn put up in a loose loop when taken from a reel so that strand 21 may be continuously drawn from the center of the skein outwardly, with negligible twisting and tangling of the strand. The skeins will, however, if unrestrained, tend to roll as the strands are withdrawn, so that the strands tangle together. Bags 14 of stand 10 serves to immobilize the skeins 20, so that the separate strands 21 are drawn untangled to the knitting piece, as described above. Bags 14 are preferably proportioned to support skeins 20 generally vertically, so that strands 21 may be freely withdrawn from the centers of the skeins. The skeins 20 remain conveniently stored in the bags when not being used, and stand 10 is easily portable.

Stand base 11 preferably comprises a circular base plate 25 having a flat under surface 26 for resting upon a floor or other flat surface. An upstanding circumferential base rim 27 and intersecting diametral cross ribs 28 serve to stiffen base 11, and to provide upwardly open compartments **29*a*** for storage of sewing accessories, such as thread, buttons and the like.

In the illustrated embodiment, intersecting ribs 28 are enlarged near the center of base 11 to form a thickened cruciform 29 with a cruciform recess 30 therewithin adapted to frictionally engage the lowermost end portion of stem 12, which is provided in similar cruciform cross section. (FIGS. 1, 2, 3, and 5)

Hook carrying stem capital 13, seen in FIGS. 1, 2, 4, and 6, preferably comprises a circular cap plate 31, with a downstanding circumferential cap rim 32, and intersecting cap ribs 33, which together stiffen capital 13. Ribs 33 carry a downwardly opening cruciform cap recess 34 adapted to frictionally secure capital 13 to the uppermost portion of cruciform stem 12. Thus, stand 10 may be shipped or stored "knocked down," and assembled without tools or screws, clamps or other fasteners.

Stem capital 13 carries about its circumference a plurality of equally spaced apart bag hooks 15 projecting radially beyond cap rim 32. Upstanding stud portions 19 are preferably cylindrical and of substantial diameter to minimize tearing of bags 14, which are preferably of thin wall, transparent plastic for economy and ready visibility of skein color and yarn supply.

For stability, stand base 11 and capital 13, with hooks 15, are proportioned to hold bags 14 directly above base 11. Preferably, the length of stem 12 and bags 14 are selected so that the bottom of bags 14 rest upon base 11, so that skeins 20 are principally supported thereon, to relieve bag tearing stresses upon hook perforations 16, and to avoid any weight induced diametral compression distortion of skeins 20, which could result in strand binding or tangling.

Preferably, base 11, stem 12 and capital 13 are of molded plastic. However, any other suitable material with significant rigidity could be employed, such as wood, pressed wood, or metal. These components could be constructed partially or completely integral with each other, rather than separately as illustrated. More than one upstanding stem could be employed, each with hooks 15 or other bag attaching provisions, such as clamps for example, secured at each of their upper extensions. Neither base 11 nor capital 13 need be restricted to circular shapes, nor stem 12 to cruciform. These and other embodiments of yarn stand 10 could be employed without departing from the essential spirit of the invention. The embodiments described and presented herein are for illustrative purposes only. The boundaries of the invention are those defined by the appended claims. All embodiments defined therein, and all equivalents thereof, are intended to be embraced therein.

I claim:

1. A free standing yarn dispenser comprising:

a lowermost base member adapted to rest upon a floor;

at least one elongate stem member upstanding from the base member;

at least two bags each adapted to contain a skein of yarn therewithin; and means adapted to secure each having an open end and of the bags at its open end from the uppermost portion of a one of the stems in separated relationship to each other.

2. The yarn dispenser of claim 1, wherein:

the means adapted to secure the bags to the stems comprises a separate hooking member for each bag; and each bag carries a hooking perforation through its wall near the open end thereof adapted to engage a one of the hooking members.

3. The yarn dispenser of claim 2, wherein:

each bag is proportioned to retain a skein of yarn therein with the longitudinal axis thereof substantially vertical.

4. The dispenser of claim 3, wherein:

each bag carries a strand perforation through the wall thereof above the skein, through which the strand of the skein may be freely drawn.

5. The yarn dispenser of claim 2, further comprising:

a capital member secured to the uppermost portion of the stem, the hooking members being secured to said capital member; and wherein the base comprises a flat plate member.

6. The yarn dispenser of claim 5, wherein:

the base further comprises an upstanding rim the full perimeter thereof and at least one upstanding rib thereacross.

7. The yarn dispenser of claim 5, wherein:

the stem and base are adapted for frictional securement removably together; and the stem and container support member are adapted for frictional securement removably together.

8. A free standing yarn dispenser comprising:

a lowermost base comprising a circular base plate with an upstanding base rim therearound integral therewith and two upstanding diametral base ribs thereacross integral therewith and each with the other at the center of the base plate, said ribs forming an upwardly opening cruciform base recess therewithin at the center of the base plate;

an elongate stem formed in cross section to frictionally engage the base recess so as to upstand removably therefrom;

a stem capital comprising a circular capital plate of substantially smaller diameter than the base end with a downstanding capital rim therearound integral therewith and two downstanding diametral capital ribs thereacross integral therewith and each with the other at the center of the capital plate, said rims forming a downwardly opening cruciform capital recess therewithin at the center of the capital plate, said capital recess being adapted to frictionally engage the uppermost end portion of the stem removably therefrom, and a plurality of hooks spaced apart circumferentially therearound; and a plurality of elongate bags each having a hooking perforation through its wall at its open end for removable securement each to a one of the hooks so as to be supported downwardly therefrom, and each adapted to retain an elongate skein of yarn therein generally coaxially with the bag.

9. The yarn dispenser of claim 8, wherein:

each bag is further proportioned so that the weight of the skein is substantially supported by the base;

each bag carries a yarn strand passing perforation through its wall above the skein; and an elastic band adapted to retain the open ends of the bags closed against the stem above the strand perforation and below the hooks.

10. A free standing yarn dispenser comprising:

a lowermost base adapted to rest upon a floor;

at least one elongate stem upstanding from the base;

at least two yarn containers each adapted to receive a skein of yarn therewithin and to permit withdrawal of the strand of the skein freely therefrom;

means adapted to secure each of the yarn containers to a one of the stem members in separated relationship to each other; and the stem and base are adapted for frictional securement removably together.

11. A free standing yarn dispenser comprising:

a lowermost base member adapted to rest upon a floor;

at least one elongate stem member upstanding from the base member, said stem and base member being adapted for removable frictional securement together;

at least two bags each adapted to contain a skein of yarn therewithin; and means adapted to secure each having an open end and of the bags at its open end from the uppermost portion of a one of the stems in separated relationship to each other.

* * * * *